US005486034A

United States Patent [19]

Dalke

[11] Patent Number: 5,486,034

[45] Date of Patent: Jan. 23, 1996

[54] ROCKER APPARATUS

[76] Inventor: Donell R. Dalke, 1832 N. McComas, Wichita, Kans. 67203

[21] Appl. No.: 336,993

[22] Filed: Nov. 10, 1994

[51] Int. Cl.[6] ..... A47C 3/02

[52] U.S. Cl. ..... 297/272.1; 297/133

[58] Field of Search ..... 297/272, 261, 297/133, 130

[56] References Cited

U.S. PATENT DOCUMENTS

| | | | |
|---|---|---|---|
| 232,147 | 9/1880 | Reynolds . | |
| 264,917 | 9/1882 | Andrews . | |
| 271,907 | 2/1883 | Olmsted . | |
| 304,435 | 9/1884 | Malick . | |
| 315,369 | 4/1885 | Work . | |
| 328,000 | 10/1885 | Brown . | |
| 381,878 | 4/1888 | Holman . | |
| 405,919 | 6/1889 | Straus et al. . | |
| 524,151 | 8/1894 | Walker | 297/272 |
| 744,993 | 11/1903 | Barta . | |
| 921,813 | 5/1909 | Druhman . | |
| 1,228,521 | 6/1917 | Bell . | |
| 1,317,580 | 9/1919 | Kanode | 297/272 |
| 1,367,390 | 2/1921 | Hinson . | |
| 1,535,298 | 4/1925 | Drabinsky . | |
| 2,662,580 | 12/1953 | Gottfried . | |
| 3,306,660 | 2/1967 | Williams | 297/133 |
| 4,079,991 | 3/1978 | Harris . | |
| 4,126,353 | 11/1978 | Clough . | |
| 4,285,543 | 8/1981 | Clark . | |
| 5,013,086 | 5/1991 | Benzur . | |
| 5,246,268 | 9/1993 | Lerner et al. . | |

FOREIGN PATENT DOCUMENTS

| | | | |
|---|---|---|---|
| 0430088 | 8/1967 | Switzerland | 297/272 |

*Primary Examiner*—James R. Brittain
*Assistant Examiner*—Anthony D. Barfield
*Attorney, Agent, or Firm*—Hovey, Williams, Timmons & Collins

[57] ABSTRACT

A rocker apparatus for converting a conventional chair or crib into a rocking device is provided. The rocker apparatus includes an arcuate rocker member and a grasping assembly for coupling the arcuate rocker member to the chair legs. The grasping assembly includes a guide member and a grasping arm. The guide member is slidingly engaged on the rocker member. A spring assembly pivotally couples the grasping arm to the guide member. The grasping arm is pivotal between a leg securing position wherein the grasping assembly grasps the chair or crib and a leg release position wherein the grasping assembly releases the chair or crib.

15 Claims, 2 Drawing Sheets

ROCKER APPARATUS

BACKGROUND OF THE INVENTION

1. Field of the Invention

The present invention is related to rocking devices, and more particularly to a rocker apparatus which detachably couples to the legs of a chair or crib for converting the chair or crib into a rocking device.

2. Description of the Prior Art

Detachable rocker devices for mounting on the legs of chairs and cribs are known in the art. For example, U.S. Pat. Nos. 304,435 and 405,919 disclose detachable rockers for converting standard chairs into rocking chairs. Similarly, U.S. Pat. No. 381,878 discloses an attachment device for converting a standard crib into a rocking cradle.

Although prior art rocker devices convert standard chairs into rocking chairs, they suffer from several limitations. For example, many prior art detachable rocker devices are designed to fit a particular size chair and are not adjustable. Typically, these prior art rocker devices include a clamping structure which is rigidly attached to a rocker member at a specific location. Only chairs with legs positioned in the same location as the clamping structures can be used with these devices. Thus, a plurality of detachable rocker devices must be provided for different sized chairs.

Another limitation of prior art rocker devices is that their clamping structures are difficult to attach and remove. These clamping structures are typically attached to the chair legs with screws or other hardware and require tools to assemble. Thus, they cannot be easily removed from one chair and attached to another.

Accordingly, there is a need for an improved detachable rocker device which overcomes the limitations of the prior art. More particularly, there is a need for a rocker apparatus which can be attached to chairs having legs spaced any distance apart. Additionally, there is a need for a rocker apparatus which can be easily attached to and removed from a chair or crib without the use of tools.

SUMMARY OF THE INVENTION

In view of the limitations in the prior art outlined above, it is an object of the present invention to provide an improved rocker apparatus for converting a conventional chair or crib into a rocking device.

It is also an object of the present invention to provide a rocker apparatus which is adjustable to fit different sizes chairs.

It is also an object of the present invention to provide a rocker apparatus which is easy to attach and remove from a chair or crib without the use of tools.

In accordance with these and other objects evident from the following description of a preferred embodiment of the invention, an improved rocker apparatus for converting a conventional chair or crib into a rocking device is provided. The rocker apparatus is configured for detachably coupling with a piece of furniture having at least two legs depending therefrom, such as a chair or crib. A pair of identical left and right rocker apparatuses are attached to the legs of each side of the furniture to convert the furniture into a rocking device.

The preferred rocker apparatus broadly includes an arcuate rocker member and a grasping assembly for coupling the arcuate rocker member to the chair legs. In more detail, the arcuate rocker member includes an elongated curved rocker bar having opposed distal and proximal ends and a pair of parallel spaced adjustment rails extending between the curved rocker bar ends. In preferred forms, the curved rocker bar and the adjustment rails are formed of steel.

The grasping assembly is attached to the arcuate rocker member and is configured for coupling the arcuate rocker member to the chair or crib. In preferred forms, a pair of grasping assemblies are provided for each rocker member. The grasping assembly includes a guide member and a grasping arm. The guide member is slidingly engaged on the adjustment rails and is operable to slide along the entire length of the adjustment rails. The grasping arm includes structure for engaging the legs of the chair or crib. A spring assembly pivotally couples the grasping arm to the guide member. The grasping arm is pivotal between a leg securing position wherein the grasping assembly grasps the chair or crib and a leg release position wherein the grasping assembly releases the chair or crib.

To attach the arcuate rocker members to the chair legs, the grasping assemblies of one of the rocker apparatuses are first positioned along adjustment rails to engage the chair legs. Once the grasping assemblies are properly positioned, the grasping arm is placed over the chair leg and the grasping arm is pivoted to the leg securing position. These steps are repeated to attach the second rocker apparatus to the second side of the chair.

With this configuration, numerous advantages are obtained. For example, since the grasping assemblies are slidingly engaged on the adjustment rails, the rocker apparatus can be adjusted to fit chairs of various sizes. Additionally, since the grasping arms are pivotally mounted, the rocker apparatus can be easily attached to or removed from the legs of a chair or crib without the use of tools.

BRIEF DESCRIPTION OF THE DRAWING FIGURES

A preferred embodiment of the invention is described in detail below with reference to the attached drawing figures, wherein.

DETAILED DESCRIPTION OF THE PREFERRED EMBODIMENTS

Figure 1:
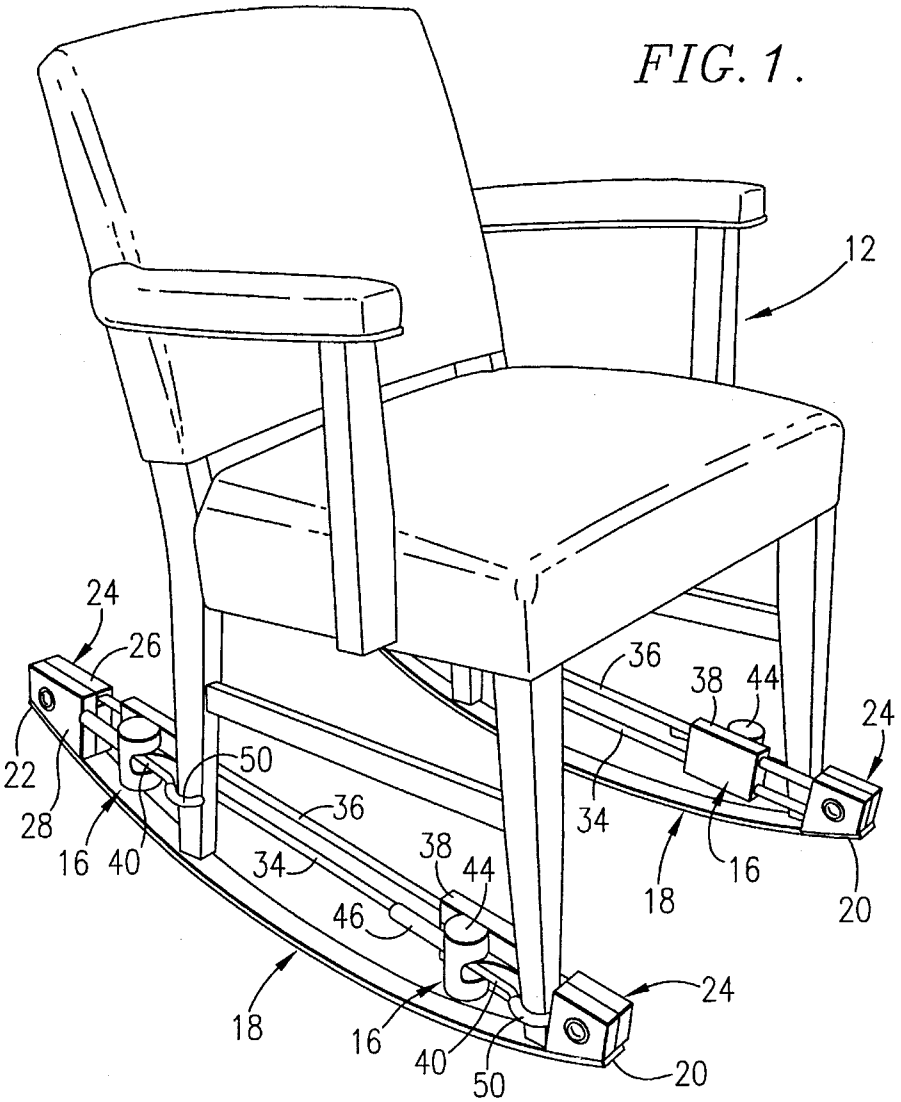
FIG. 1 is a perspective view of a rocker apparatus constructed in accordance with the preferred embodiment shown attached to a conventional chair.
Figure 4:
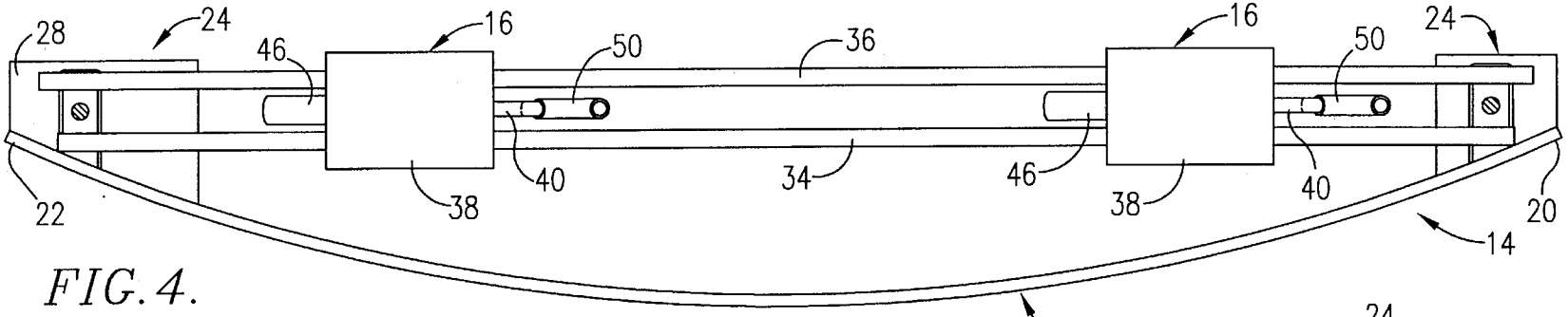
FIG. 4 is an exterior side view of the apparatus.

Turning now to the drawing figures, and particularly FIG. 1, a rocker apparatus constructed in accordance with the preferred embodiment of the present invention is illustrated. The preferred rocker apparatus broadly includes an arcuate rocker member 14 and a grasping assembly 16 for coupling the arcuate rocker member 14 to a conventional chair 12. A pair of identical left and right rocker apparatuses are attached to the legs of each side of the chair 12 to convert the chair into a rocking chair. As those skilled in the art will appreciate, the rocker apparatus may be used to convert any furniture having legs, such as a crib or ottoman, into a rocking device.

Figure 2:
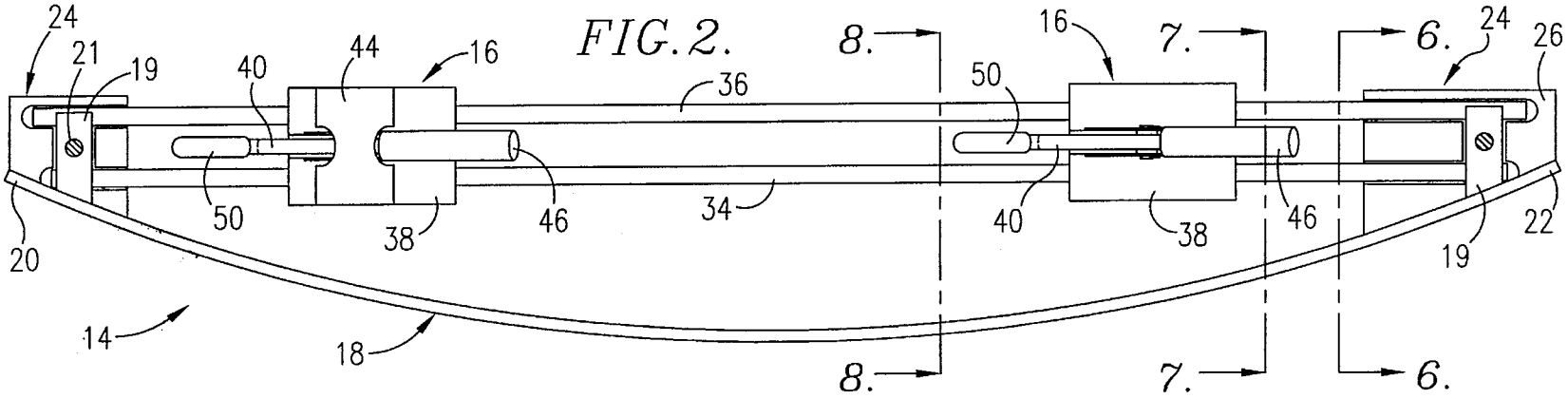
FIG. 2 is an interior side view of the apparatus.

In more detail, the arcuate rocker member 14 includes a rocker bar 18, a pair of flanges 24 attached to the ends of the rocker bar 18, and a pair of adjustment rails 34 and 36 extending between the flanges 24. The rocker bar 18 is formed from an elongated length of flattened steel. The rocker bar 18 presents opposed distal and proximal ends 20 and 22 which are curved upwardly in a bowed configuration. In preferred forms, the rocker bar 18 is 24"–36" in length and presents a width of approximately 1"–2". A pair of attachment columns 19 (FIG. 2) are welded or fastened to each of the distal and proximal ends 20 and 22 of the rocker bar 18. The attachment columns 19 extend upwardly from the rocker bar 18 for supporting a pair of adjustment rails 34 and 36 as described in detail below. The attachment columns 19 include walls defining bolt receiving orifices 21 extending therethrough.

Figure 7:
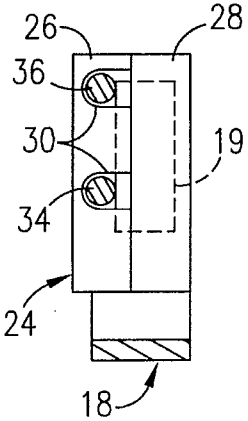
FIG. 7 is a sectional view of the apparatus taken along line 7—7 of FIG. 2.
Figure 3:
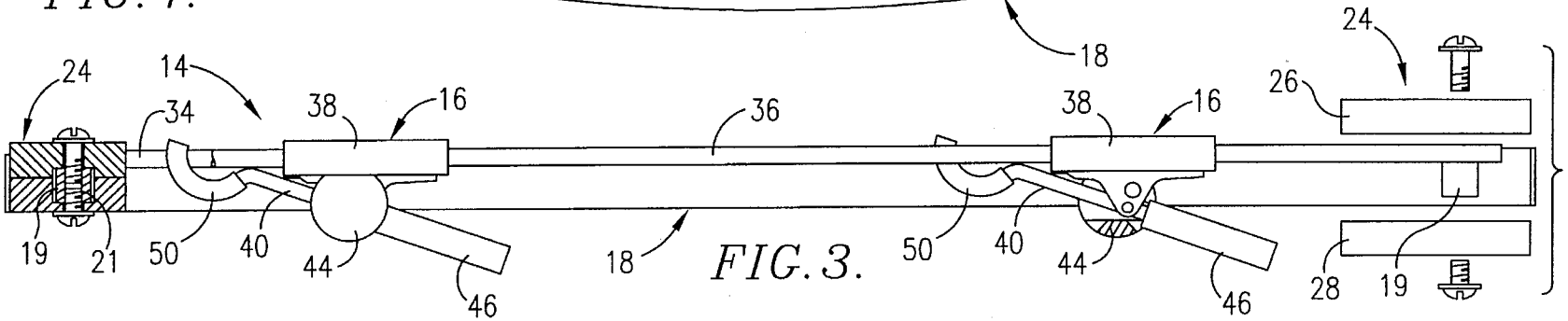
FIG. 3 is a plan view of the apparatus depicting the components of one end thereof exploded.

As illustrated in FIG. 3, the flanges 24 are attached to the ends of rocker bar 18 and each include a pair of mating left and right attachment members 26 and 28 which join together to cover the attachment columns 19. The left and right attachment members 26 and 28 are connected together by conventional bolts or screws extending through the bolt receiving orifices 21 of the attachment columns 19. As best illustrated in FIG. 7, the left support member 26 includes walls defining a plurality of hollow channels 30 for receiving the adjustment rails 34 and 36. In preferred forms, the flanges 24 are formed of wood.

Figure 6:
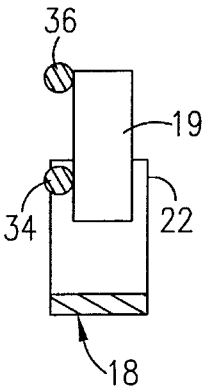
FIG. 6 is a sectional view of the apparatus taken along line 6—6 of FIG. 2.

Parallel spaced adjustment rails 34 and 36 extend between the flanges 24 and provide support for the grasping assembly 16 as described below. The adjustment rails 34 and 36 are formed from elongated steel rods and extend the entire length between the distal and proximal ends 20 and 22 of the curved bar 18. As illustrated in FIG. 6, the ends of the adjustment rails 34 and 36 are welded or attached to the attachment columns 19 of the rocker bar 18. In preferred forms, the adjustment rails 34 and 36 are formed of steel rods presenting a diameter of approximately ¼"–½".

The grasping assembly 16 is coupled to the rocker member 14 and is configured for coupling the rocker member 14 to the chair 12. A pair of identical grasping assemblies 16 are provided for each rocker apparatus. Each grasping assembly 16 secures one of the legs of the chair 12 to the rocker member 14 to convert the chair 12 into a rocking chair.

Figure 5:
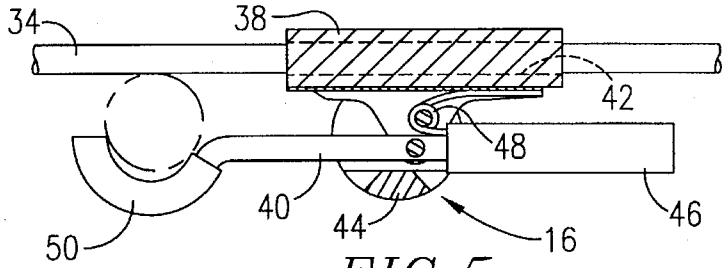
FIG. 5 is an enlarged view illustrating a portion of the rocker apparatus in more detail.
Figure 8:
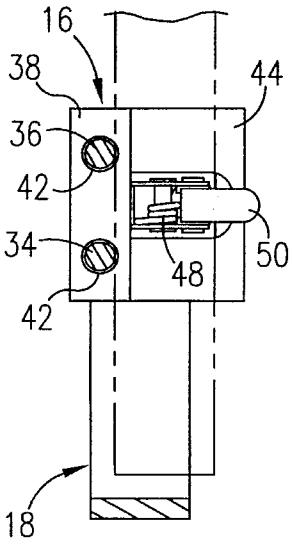
FIG. 8 is a sectional view of the apparatus taken along line 8—8 of FIG. 2.

As best illustrated in FIG. 5, the grasping assembly 16 broadly includes a guide member 38 and a grasping arm 40. The guide member 38 is rectangular in shape and is slidingly attached to the adjustment rails 34 and 36 of the rocker member 14. The guide member 38 includes walls defining a pair of hollow passageways 42 extending parallel to the axis of the adjustment rails 34 and 36. As best illustrated in FIG. 1, the guide member 38 is placed over the adjustment rails 34 and 36 so that the adjustment rails 34 and 36 extend through the hollow passageways 42. Thus, the guide member 38 is slidingly engaged on the adjustment rails 34 and 36 and is operable to slide along the entire length of the adjustment rails 34 and 36.

A circular dowel 44 is attached to one side of the guide member 38. The circular dowel 44 includes walls defining a hollow chamber which allows the dowel 44 to be placed over a grasping arm 40 as described below. The guide member 38 and the circular dowel 44 are preferably formed of wood.

The grasping arm 40 is pivotally coupled to the guide member 38 and is operable for selectively engaging and disengaging the legs of chair 12. The grasping arm 40 includes an elongated lever arm 46 coupled to a biasing spring assembly 48. The grasping arm 40 also includes a grasping hook 50 on one of its ends. The grasping hook 50 is sized and positioned so that its open end engages a chair leg.

A spring assembly 48 pivotally couples the grasping arm 40 to the guide member 38 (see FIG. 5). The spring assembly 48 is attached to the guide member 38 by conventional means and allows the grasping arm 40 to pivot between a leg securing position and a leg release position. While in the leg securing position, the grasping arm 40 is pivoted towards the chair 12 and the grasping hook 50 grasps the chair leg. Alternately, while in the leg release position, the grasping arm 40 is pivoted away from the chair 12 and the grasping hook 50 releases the chair leg. The spring assembly 48 normally biases the grasping arm 40 to the leg securing position.

In operation, a pair of rocker apparatuses are attached to the legs of a conventional chair 12 for converting the chair into a rocking chair. To attach the arcuate rocker members 14 to the chair legs, the grasping assemblies 16 of one of the rocker apparatuses are first positioned along adjustment rails 34 and 36 to engage the chair legs. Once the grasping assemblies 16 are properly positioned, the grasping hook 50 of the grasping arm 40 is placed over the chair leg and the grasping arm 40 is pivoted to the leg securing position. These steps are repeated to attach the second rocker apparatus to the chair 12.

Since the grasping assemblies 16 are slidingly engaged on the adjustment rails 34 and 36, the rocker apparatuses can be adjusted to fit chairs of various sizes. Additionally, since the grasping arms 40 are pivotally mounted to the spring assemblies 48, the rocker apparatuses can be easily attached to or removed from the legs of a chair without the use of tools. For example, to detach the rocker apparatuses from the chair 12, the grasping arms 40 are simply pivoted to the leg release positions and the chair legs are removed from the grasping assemblies 16.

Although the invention has been described with reference to the preferred embodiment illustrated in the attached drawing figures, it is noted that equivalents may be employed and substitutions made to the preferred embodiment described herein without departing from the scope of the invention as recited in the claims. For example, although the rocker apparatus is described and illustrated as being attached to a chair, the rocker apparatus may be used to convert any furniture having legs, such as a crib or ottoman, into a rocking device.

Having thus described the preferred embodiments of the invention, what is claimed as new and desired to be protected by Letters Patent includes the following:

1. A rocker apparatus configured for detachably coupling with a piece of furniture having at least two legs depending therefrom for converting the furniture into a rocking device, comprising:

an arcuate rocker member including an elongated curved rocker bar presenting opposed distal and proximal ends and an adjustment rail extending between said ends;

a grasping assembly attached to said arcuate rocker member for grasping the furniture legs and coupling said arcuate member to the furniture, said grasping assembly including a grasping arm which is pivotal between a leg securing position wherein said grasping assembly grasps the furniture and a leg release position wherein said grasping assembly releases the furniture; and adjustment means for selectively positioning said grasping assembly along the length of said adjustment rail.

2. The rocker apparatus as set forth in claim 1, said adjustment means including a guide member slidingly engaged on said adjustment rail, wherein said guide member is operable to slide along the entire length of said adjustment rail.

3. The rocker apparatus as set forth in claim 2, said grasping arm including a hook member disposed on one end thereof for engaging the furniture legs.

4. The rocker apparatus as set forth in claim 3, said elongated arcuate member including a pair of parallel spaced apart adjustment rails extending between said opposed distal and proximal ends.

5. The rocker apparatus as set forth in claim 3, said hook member including a protective sheath covering for preventing damage to the furniture legs.

6. The rocker apparatus as set forth in claim 1 including a pair of elongated arcuate members.

7. The rocker apparatus as set forth in claim 6, wherein each elongated arcuate member includes a pair of grasping assemblies.

8. The rocker apparatus as set forth in claim 1, said elongated arcuate member being formed of steel.

9. The rocker apparatus as set forth in claim 1, said grasping assembly being formed of steel.

10. A rocker apparatus configured for detachably coupling with a piece of furniture having at least two legs depending therefrom for converting the furniture into a rocking device, comprising:

an elongated arcuate member including opposed distal and proximal ends and a pair of parallel spaced adjustment rails extending therebetween; and a grasping assembly slidingly engaged on said adjustment rails for grasping the furniture legs and coupling said arcuate member to the furniture, said grasping assembly including— a guide member slidingly engaged on said adjustment rails, wherein said guide member is operable to slide along the entire length of said adjustment rail, and a grasping arm pivotally coupled to said guide member and including a hook member for engaging the furniture legs, wherein said grasping arm is pivotal between a leg securing position wherein said grasping assembly grasps the furniture and a leg release position wherein said grasping assembly releases the furniture.

11. The rocker apparatus as set forth in claim 10 including a pair of elongated arcuate members.

12. The rocker apparatus as set forth in claim 11, wherein each elongated arcuate member includes a pair of grasping assemblies.

13. The rocker apparatus as set forth in claim 12, said hook member including a protective sheath covering for preventing damage to the furniture legs.

14. The rocker apparatus as set forth in claim 13, said elongated arcuate member being formed of steel.

15. The rocker apparatus as set forth in claim 14, said grasping assembly being formed of steel.

* * * * *